US005243353A

United States Patent [19]

Nakahara et al.

[11] Patent Number: 5,243,353

[45] Date of Patent: Sep. 7, 1993

[54] CIRCULARLY POLARIZED BROADBAND MICROSTRIP ANTENNA

[75] Inventors: Shintaro Nakahara; Makoto Matsunaga, both of Kamakura, Japan

[73] Assignee: Mitsubishi Denki Kabushiki Kaisha, Tokyo, Japan

[21] Appl. No.: 605,706

[22] Filed: Oct. 30, 1990

[30] Foreign Application Priority Data

Oct. 31, 1989 [JP] Japan ..... 1-283704

[51] Int. Cl.[5] ..... H01Q 1/38; H01Q 21/06

[52] U.S. Cl. ..... 343/700; 343/846

[58] Field of Search ..... 343/700 MS File, 829, 343/846

[56] References Cited

U.S. PATENT DOCUMENTS 4,761,654 8/1988 Zaghloul ..... 343/700

4,847,625 7/1989 Dietrich et al. ..... 343/700

FOREIGN PATENT DOCUMENTS 271458 6/1988 European Pat. Off. .

160103 12/1981 Japan ..... 343/700

207703 11/1984 Japan ..... 343/700

281704 12/1986 Japan .

OTHER PUBLICATIONS

"Influence of Director Size upon a Microstrip Quadratic Patch Bandwidth," G. Dubost, J. Rocquencourt, and G. Bonnet, 1987 *International Symposium Digest, Antennas and Propagation*, pp. 940–943, IEEE, 1987.

*Primary Examiner*—Michael C. Wimer

*Attorney, Agent, or Firm*—Rothwell, Figg, Ernst & Kurz

[57] ABSTRACT

A circularly polarized microstrip antenna has a ground plane, a disk-shaped driven element, and a disk-shaped parasitic element. The driven element is located between the ground plane and the parasitic element and is parallel to both of them. The driven element and parasitic element both have diametrically opposed notches, or diametrically opposed projections, or diametrically opposed notches and diametrically opposed projections. The driven element is coupled to a conducting strip that parallels the ground plane to form a microstrip transmission line.

13 Claims, 12 Drawing Sheets

CIRCULARLY POLARIZED BROADBAND MICROSTRIP ANTENNA

BACKGROUND OF THE INVENTION

This invention relates to a circularly polarized (CP) microstrip antenna, more particularly to a circularly polarized microstrip antenna with a broad CP bandwidth. The invented antenna is useful, for example, in automobile-mounted apparatus for receiving transmissions from earth satellites.

Since the orientation of an automobile-mounted antenna with respect to a transmitting antenna on a satellite is unfixed, the automobile-mounted antenna must be able to receive transmitted radio waves regardless of the direction of their electric field vector, which is to say that the antenna must be circularly polarized. CP microstrip antennas can be found in the prior art. Japanese Patent Application Kokai Publication 281704/1986, for example, discloses a CP microstrip antenna having a disk-shaped antenna element with diametrically opposed notches.

The circular polarization characteristic of this prior-art microstrip antenna is satisfactory, however, in only an extremely narrow frequency band. Moreover, the impedance bandwidth of this antenna is extremely narrow: a slight deviation from the optimum frequency causes impedance mismatching, leading to reflection at the interface between the antenna element and its feed line.

The impedance bandwidth problem is also encountered in rectangular "patch" microstrip antennas. Improvement by addition of a rectangular parasitic director element in front of the driven antenna element has been described in, for example, "Influence of Director Size upon a Microstrip Quadratic Patch Bandwidth" by G. Dubost, J. Rocquencourt, and G. Bonnet in the IEEE 1987 *International Symposium Digest, Antennas and Propagation*, pp. 940–943, 1987. Placement of an analogous disk-shaped director in front of the circularly polarized microstrip antenna described above also improves its impedance bandwidth, but not its CP bandwidth. Tests have in fact shown that such a director has a strongly adverse effect on circular polarization.

SUMMARY OF THE INVENTION

It is accordingly an object of the present invention to increase both the impedance bandwidth and CP bandwidth of a circularly polarized microstrip antenna.

A circularly polarized microstrip antenna has a ground plane comprising a flat plate of conducting material and a parasitic element, disposed parallel to the ground plane, comprising a flat, generally circular conducting disk of radius $R_P$ with diametrically opposed portions of a different radius $R_P'$. A driven element is disposed parallel to and between the ground plane and the parasitic element, the driven element comprising a flat, generally circular conducting disk of radius $R_D'$ with diametrically opposed portions of a different radius $R_D'$. A feeding means is coupled to the driven element for feeding radio-frequency current.

DETAILED DESCRIPTION OF THE INVENTION

Novel microstrip antennas embodying the present invention will be described with reference to the drawings. Applications of these antennas are not limited to automobile reception of signals from satellites; these antennas can be used for a variety of transmitting and receiving purposes.

Figure 1:
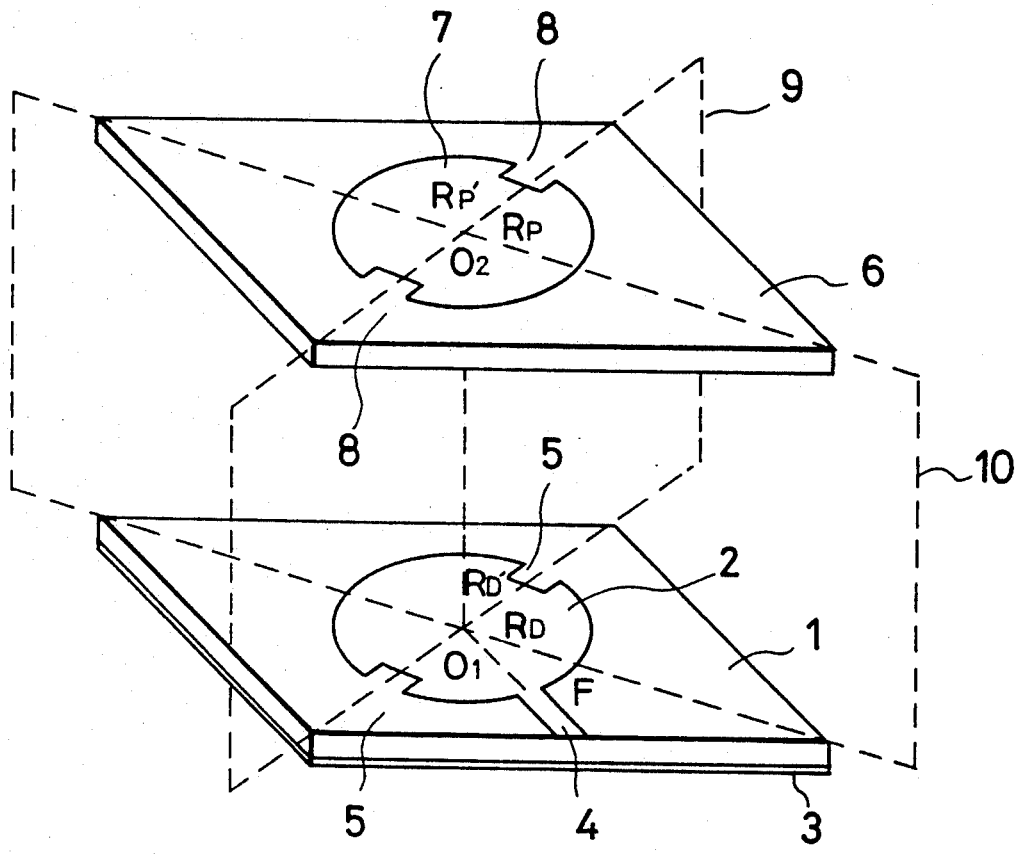
FIG. 1 is an exploded oblique view of a first novel microstrip antenna.

With reference to FIG. 1, a first novel microstrip antenna comprises a first dielectric substrate 1 having a flat, disk-shaped driven element 2 on one surface and a flat ground plane 3 on the opposite surface. The driven element 2 and ground plane 3 both comprise a conducting material such as copper. A conducting strip 4 is disposed on the same surface of the first dielectric substrate 1 as the driven element 2, one end of the conducting strip 4 being joined to a circumferential point F of the driven element 2.

The driven element 2 is generally circular with radius $R_D$, but has a pair of diametrically opposed portions with a different radius $R_D'$. Specifically, these portions are a pair of diametrically opposed notches 5 at which $R_D' < R_D$.

A second dielectric substrate 6 is disposed adjacent to the first dielectric substrate 1 on the same side as the driven element 2 and the conducting strip 4. For clarity the first dielectric substrate 1 and the second dielectric substrate 6 are shown widely separated in FIG. 1, but they may actually be spaced much closer together, or even be in contact. A parasitic element 7 comprising a flat disk of conducting material is disposed on the surface of the second dielectric substrate 6 facing away from the first dielectric substrate 1. The parasitic element 7 is generally circular with radius $R_P$, but has a pair of diametrically opposed portions with a different radius $R_P'$, more specifically a pair of diametrically opposed notches 8 at which $R_P' < R_P$.

The geometry of this microstrip antenna can be conveniently described with reference to two planes of symmetry of the driven element 2 and the parasitic element 7, a first plane of symmetry 9 and a second plane of symmetry 10, both of which are perpendicular to the driven element 2 and the parasitic element 7. The intersection of these two planes of symmetry 9 and 10 is a line, also perpendicular to the driven element 2 and the parasitic element 7, that passes through the center $O_1$ of the driven element 2 and the center $O_2$ of the parasitic element 7. The notches 5 and 8 are incident to the first plane of symmetry 9. The conducting strip 4 lies on an extension of a diameter of the conducting strip 4 making a 45° angle to the first plane of symmetry 9.

The structure comprising the conducting strip 4 and the ground plane 3 separated by the first dielectric substrate 1 forms a microstrip transmission line capable of propagating radio waves. The conducting strip 4 thus functions as a feeding means for feeding radio-frequency (rf) current to or from the driven element 2. The current consists of radio waves propagating through the dielectric between the conducting strip 4 and ground plane 3; the term "current" will also be used below in this sense.

Next the operation of this microstrip antenna will be described. The operation can best be explained by starting from the case in which the driven element has no notches and functions as a transmitting element, and there is no parasitic element.

Figure 2A:
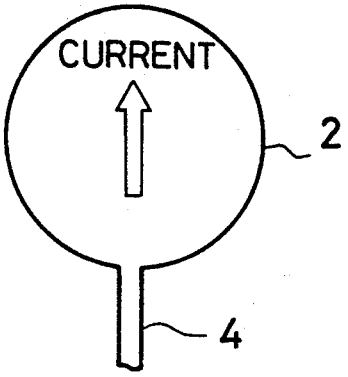
FIGS. 2A to 2C illustrate the operation, input impedance characteristics, and equivalent circuit of a microstrip antenna comprising a driven element without notches.
Figure 2B:
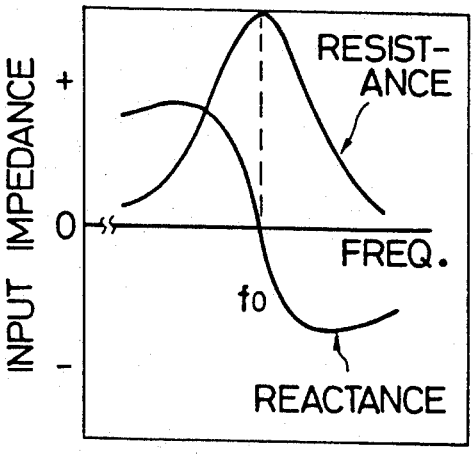
Figure 2C:
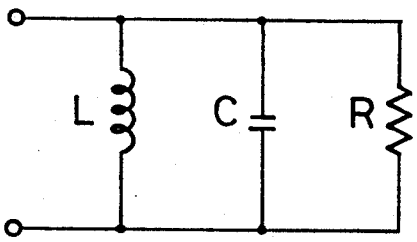

FIG. 2A shows this case schematically. When rf current is fed from the conducting strip 4 to the driven element 2, it excites a current in the driven element 2 in the principal direction indicated by the arrow. The driven element 2 has an input impedance which varies according to frequency as shown in FIG. 2B. At a certain frequency $f_0$ the resistive component of the input impedance is maximum and the reactive component is zero. At this frequency the driven element 2 is resonant, resulting in maximum radiated power, and the current in the driven element 2 is in phase with the current fed from the conducting strip 4. At frequencies below $f_0$ an inductive reactance is present, and the phase of the current in the driven element 2 leads the phase of the fed current. At frequencies above $f_0$ a capacitive reactance is present, and the phase of the current in the driven element 2 lags the phase of the fed current. These relationships can be understood from FIG. 2C, which shows an equivalent circuit of the driven element 2.

Figure 3A:
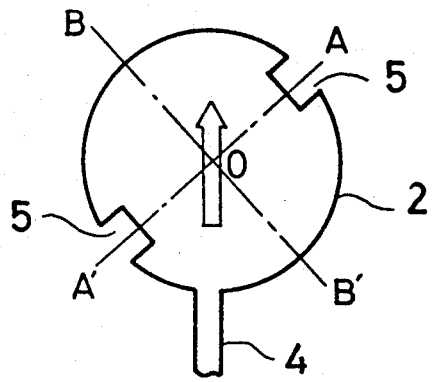
FIGS. 3A to 3C illustrate the operation of the microstrip antenna in FIG. 1.
Figure 3B:
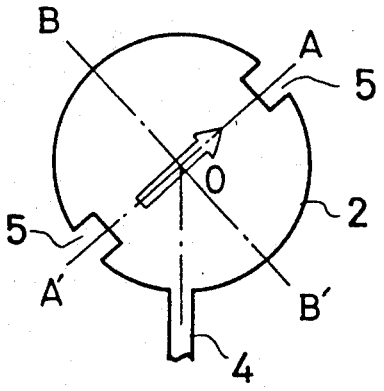

The novel microstrip antenna in FIG. 1 has notches 5 in the driven element 2 as shown in FIG. 3A. The effect of the notches can be understood by analyzing the principal current shown by the arrow in FIG. 3A into two modes: a first mode parallel to the line A-A' as shown in FIG. 3B, and a second mode parallel to the line B-B' as shown in FIG. 3B. The line A-A' lies in the first plane of symmetry 9 in FIG. 1, and the line B-B' in the second plane of symmetry 10.

Figure 3C:
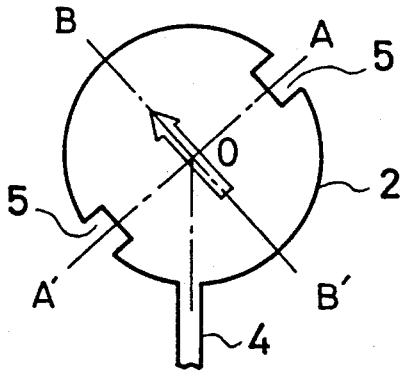
Figure 4:
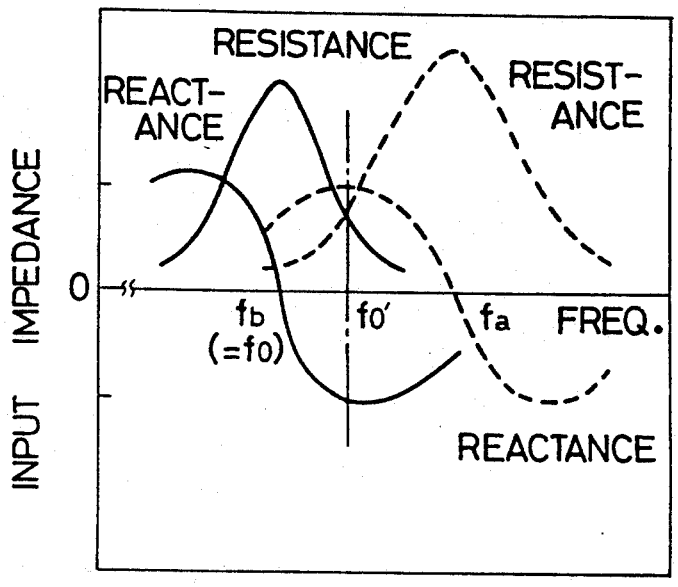
FIG. 4 illustrates the input impedance characteristics of the first and second modes shown in FIGS. 3B and 3C.

FIG. 4 illustrates the input impedance characteristics of the first and second modes shown in FIGS. 3B and 3C. The dashed lines in FIG. 4 illustrate the characteristics of the first mode shown in FIG. 3B. The solid lines illustrate the characteristics of the second mode shown in FIG. 3C. Both characteristics have the same general shape as in FIG. 2B, but due to the notches 5 in the driven element 2, the resonant frequency $f_a$ of the first mode is higher than the resonant frequency $f_b$ of the second mode. The resonant frequency $f_b$ is the same as $f_0$ in FIG. 2B.

It follows from the previous discussion that when the antenna operates at a frequency f such that $f_b<f<f_a$, the phase of the first mode leads the phase of the second mode. This is in particular true at the frequency $f_0'$ at which the two modes have equal resistive impedance and their radiation fields have equal amplitude. The displacement of $f_a$ from $f_b$ can be adjusted, by suitable selection of the area of the notches 5, so that at the frequency $f_0'$ the phases of the first and second modes are +45° and −45° with respect to the fed phase. Then the first and second modes create radiation fields of equal amplitude that differ by 90° in phase; hence the combined field radiated by the microstrip antenna is circularly polarized.

Reception by this antenna is similarly circularly polarized, enabling the antenna to receive transmissions regardless of the relative orientation of the transmitting antenna.

Figure 5:
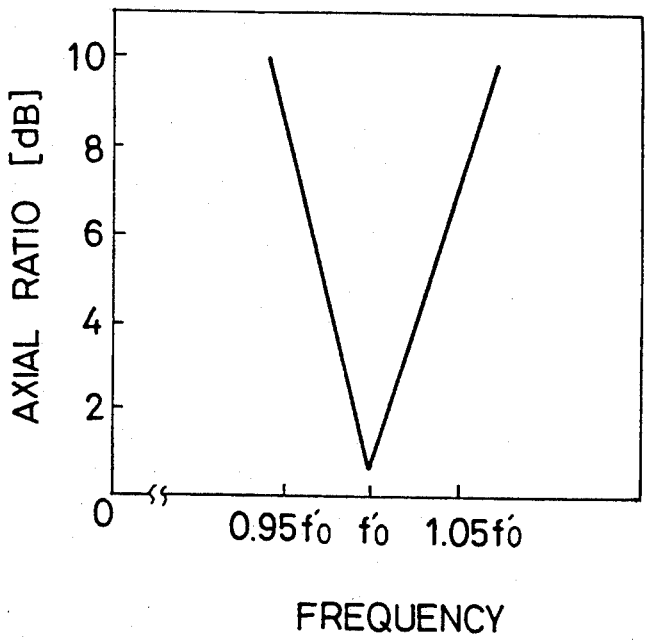
FIG. 5 illustrates the CP characteristic of the microstrip antenna in FIG. 1.

Due to the small separation between the driven element 2 and ground plane 3, a circularly polarized microstrip antenna consisting of the driven element 2 and ground plane 3 alone has very little bandwidth, but the bandwidth is increased by addition of the parasitic element 7 with diametrically opposed notches 8. FIG. 5 shows the CP characteristic of the microstrip antenna in FIG. 1, measured with a spacing of 0.2 wavelength between the driven element 2 and the parasitic element 7. The CP characteristic is defined as:

$$20\times|E_l-E_r|/(E_l+E_r)$$

where $E_l$ and $E_r$ represent the amplitude of the received signal when the transmitting antenna is rotated to the left and right, respectively. Satisfactory performance is obtained in a fairly wide band around $f_0'$. The exact shape of the CP characteristic can be tailored to requirements by suitable design of the spacing or area of the first and parasitic elements 2 and 7 and the notches 5 and 8.

Figure 6:
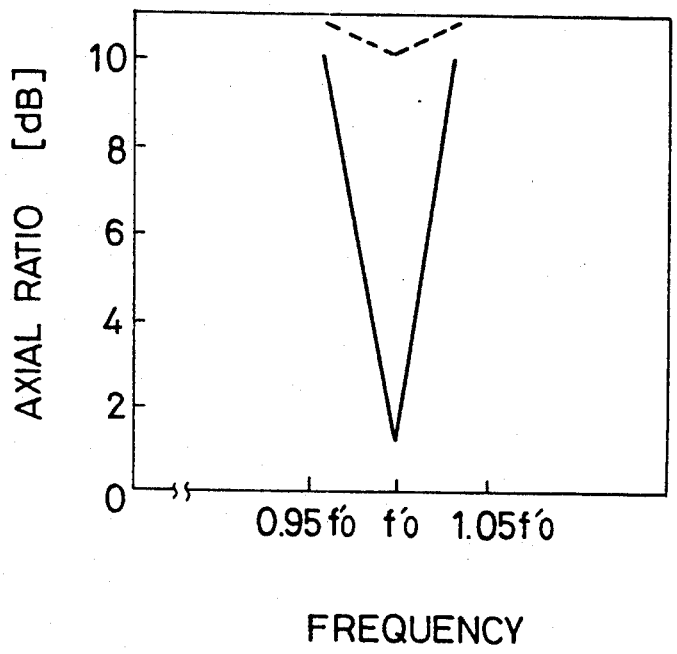
FIG. 6 illustrates the CP characteristic of a microstrip antenna having notches in only one of its antenna elements.

For comparison, FIG. 6 shows measured CP characteristics of a microstrip antenna identical to the one in FIG. 1 but having notches in only one of its elements. An antenna with notches in the driven element 2 but not in the parasitic element 7 exhibits very little circular polarization, as shown by the dashed line in FIG. 6. An antenna with notches in the parasitic element 7 but not in the driven element 2 performs better, as shown by the solid line in FIG. 6, but not nearly as well as when notches are present in both elements, as can be seen by comparing the solid lines in FIG. 5 and FIG. 6. An antenna with no parasitic element 7 and with notches in the driven element 2 has a CP characteristic similar to the solid line in FIG. 6. Thus the invented antenna is a significant improvement over the prior art.

Addition of the parasitic element 7 also improves the impedance bandwidth of the antenna, as described in the cited reference.

Figure 7:
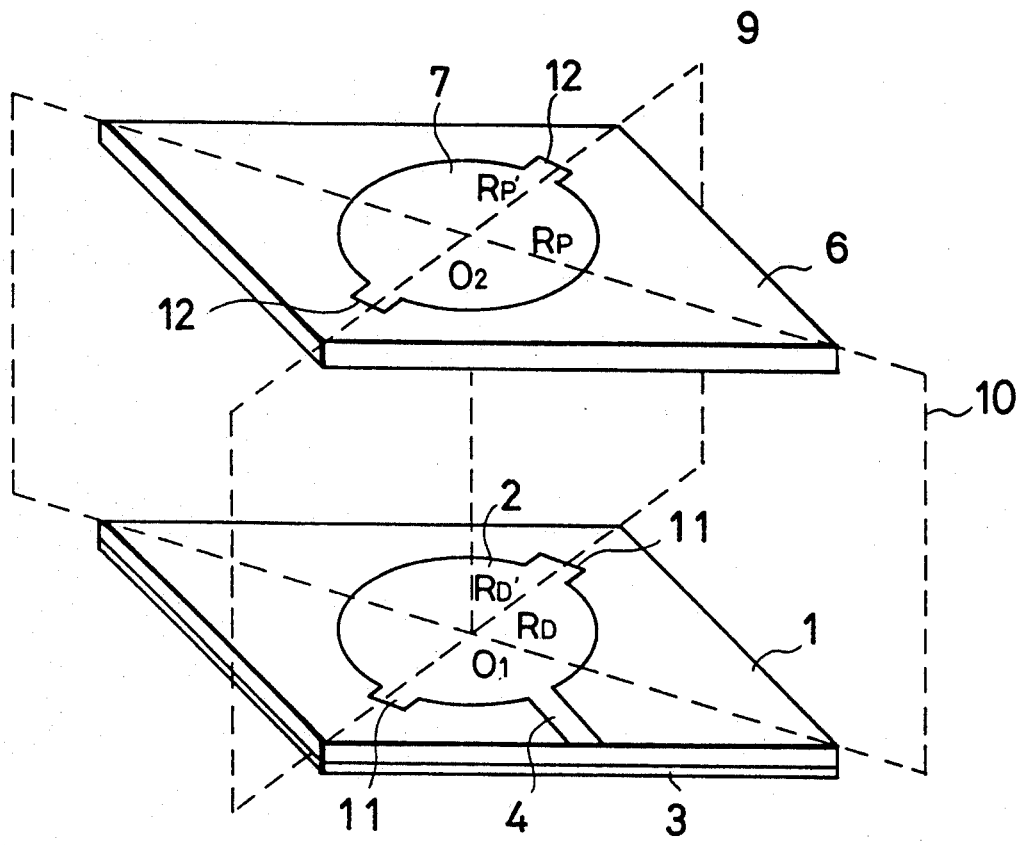
FIG. 7 is an exploded oblique view of a second novel microstrip antenna.

FIG. 7 shows a second novel microstrip antenna identical to the first except that instead of having notches, the driven element 2 has a pair of diametrically opposed projections 11 and the parasitic element 7 has a pair of diametrically opposed projections 12. Thus $R_D'>R_D$ and $R_p'>R_p$. It should be clear that the projections 11 and 12 in FIG. 7 have a similar effect to the notches 5 and 8 in FIG. 1, making the modal resonant frequency in the second plane of symmetry 10 higher than the modal resonant frequency in the first plane of symmetry 9. Since the operation of the microstrip antenna in FIG. 7 is substantially identical to the operation of the microstrip antenna in FIG. 1, further description will be omitted.

Figure 8:
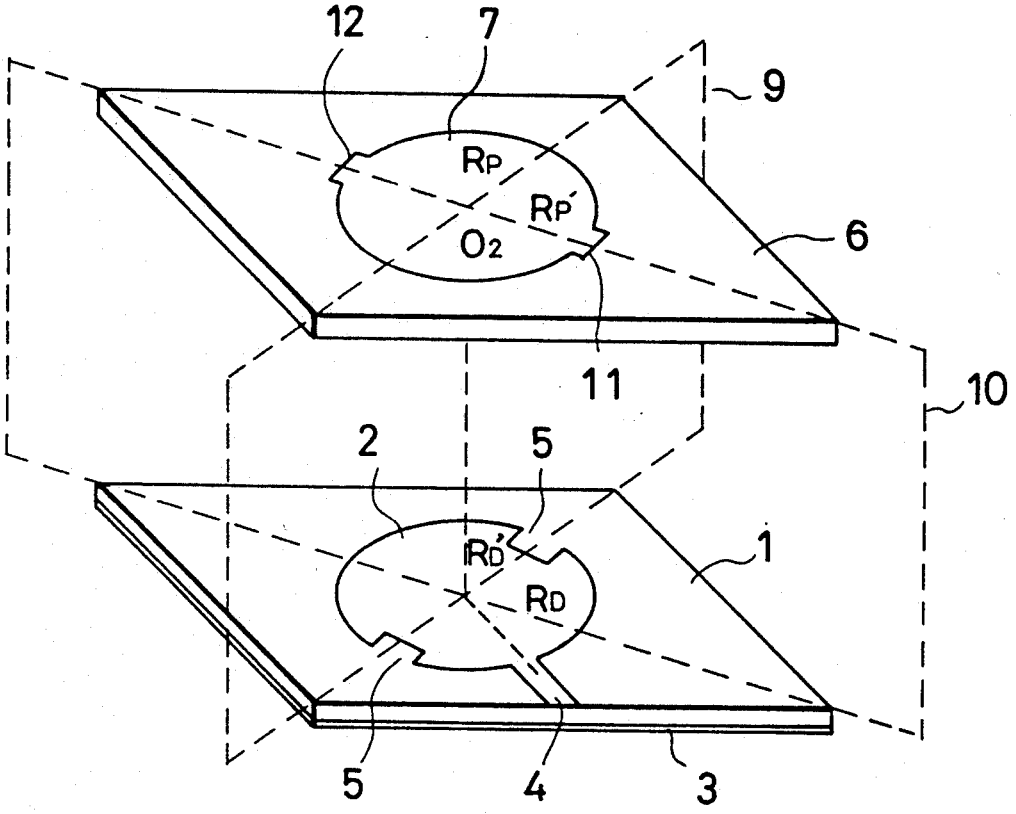
FIG. 8 is an exploded oblique view of a third novel microstrip antenna.

Projections and notches can be combined in the same microstrip antenna. FIG. 8 shows a third novel microstrip antenna in which the driven element 2 has diametrically opposed notches 5 incident to the first plane of symmetry 9, and the parasitic element 7 has diametrically opposed projections 12 incident to the second plane of symmetry 10. In this case $R_D' < R_D$ and $R_p' > R_p$.

Figure 9:
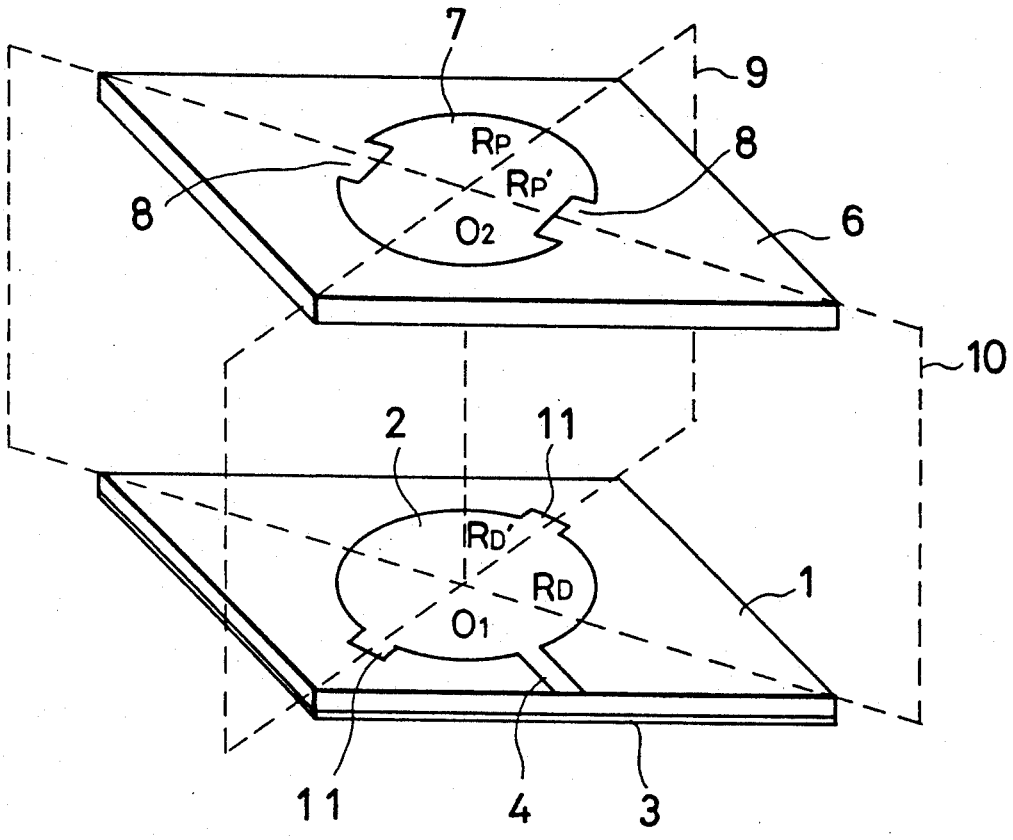
FIG. 9 is an exploded oblique view of a fourth novel microstrip antenna.

FIG. 9 shows a fourth novel microstrip antenna in which the driven element 2 has diametrically opposed projections 11 incident to the first plane of symmetry 9, and the parasitic element 7 has diametrically opposed notches 8 incident to the second plane of symmetry 10. In this case $R_D' > R_D$ and $R_p' < R_p$.

Figure 10:
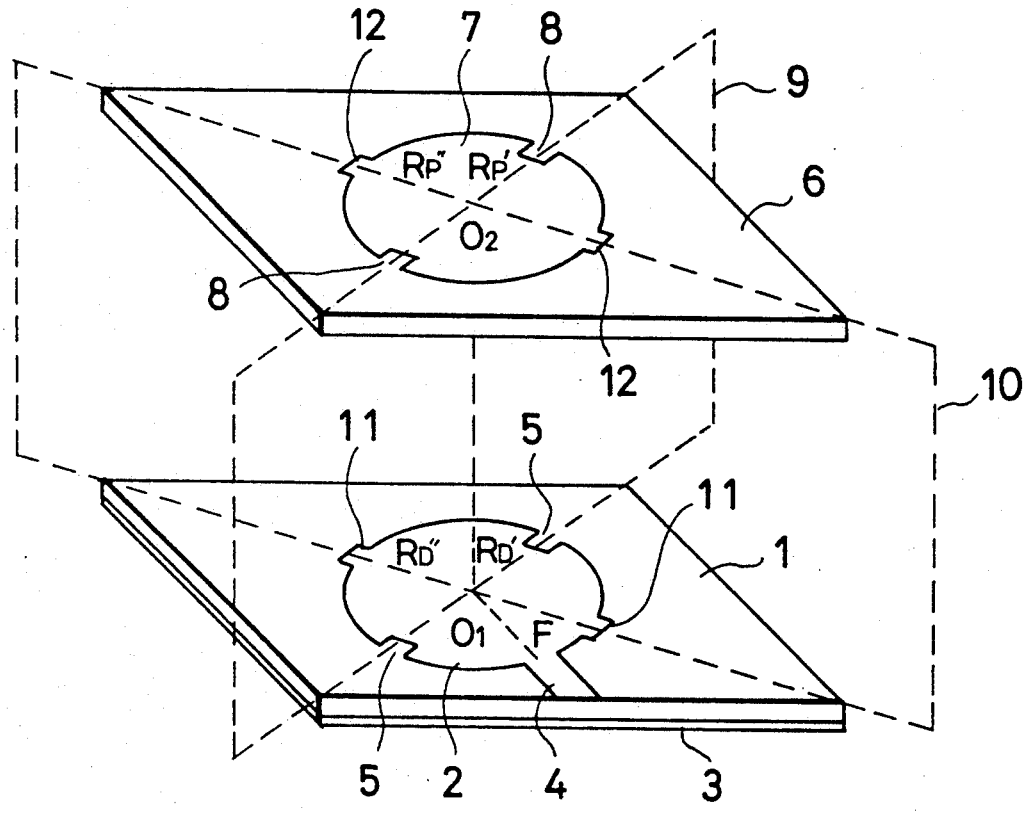
FIG. 10 is an exploded oblique view of a fifth novel microstrip antenna.

FIG. 10 shows a fifth novel microstrip antenna in which the driven element 2 has both diametrically opposed notches 5 with radius $R_D'$ incident to the first plane of symmetry 9 and diametrically opposed projections 11 with radius $R_D''$ incident to the second plane of symmetry 10, while the parasitic element 7 has both diametrically opposed notches 8 with radius $R_p'$ incident to the first plane of symmetry 9 and diametrically opposed projections 12 $R_p''$ incident to the second plane of symmetry 10. In this case $R_D' < R_D < R_D''$ and $R_p' < R_p < R_p''$.

The novel microstrip antennas in FIGS. 8, 9, and 10 all operate in substantially the same way as the microstrip antenna in FIG. 1. In FIG. 10, furthermore, it is not necessary to provide both notches and projections in the driven element 2; it suffices to provide just the notches 5 or just the projections 11.

Figure 11A:
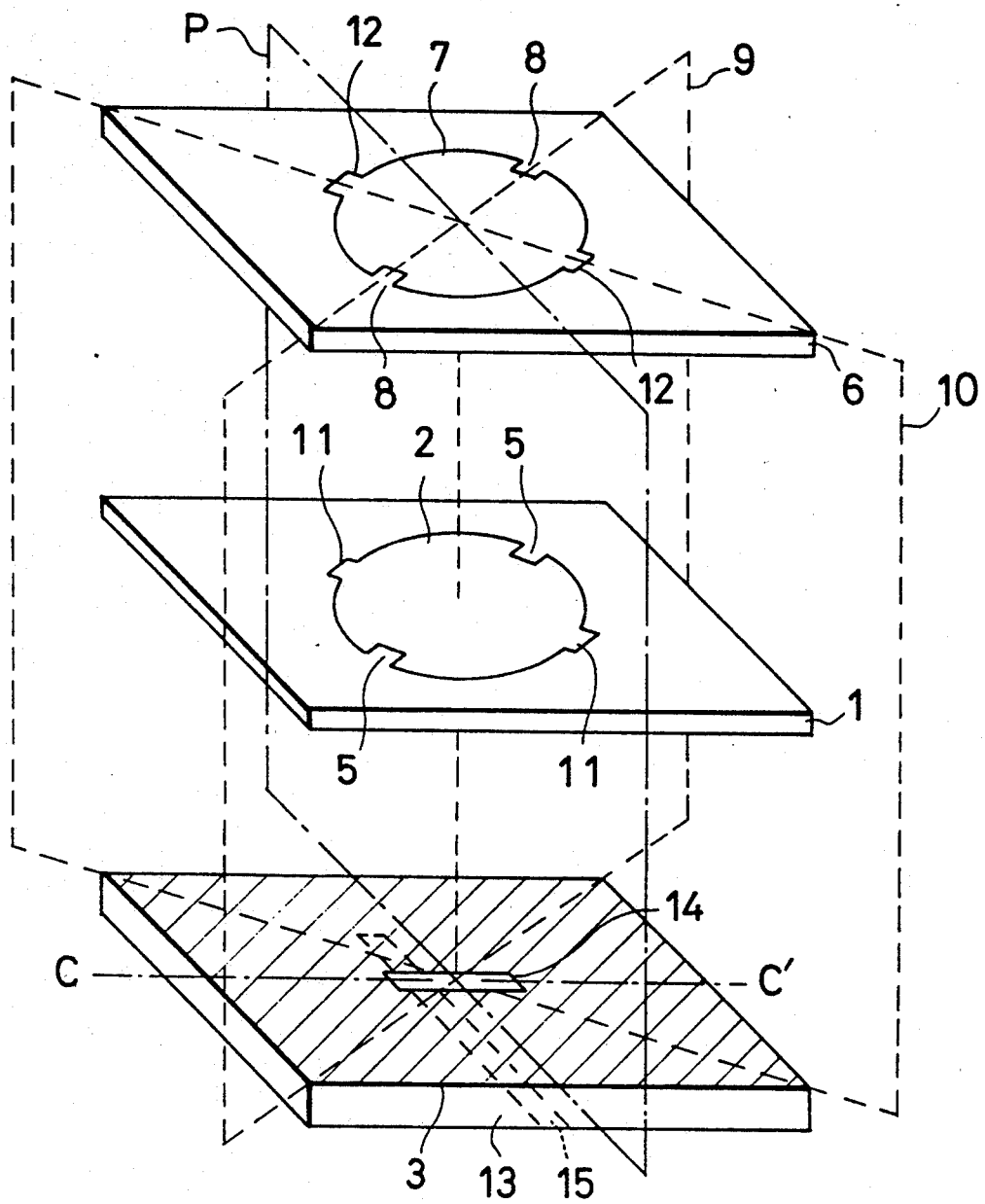
FIGS. 11A to 11C are an exploded oblique view, plan view, and sectional view of a sixth novel microstrip antenna.
Figure 11B:
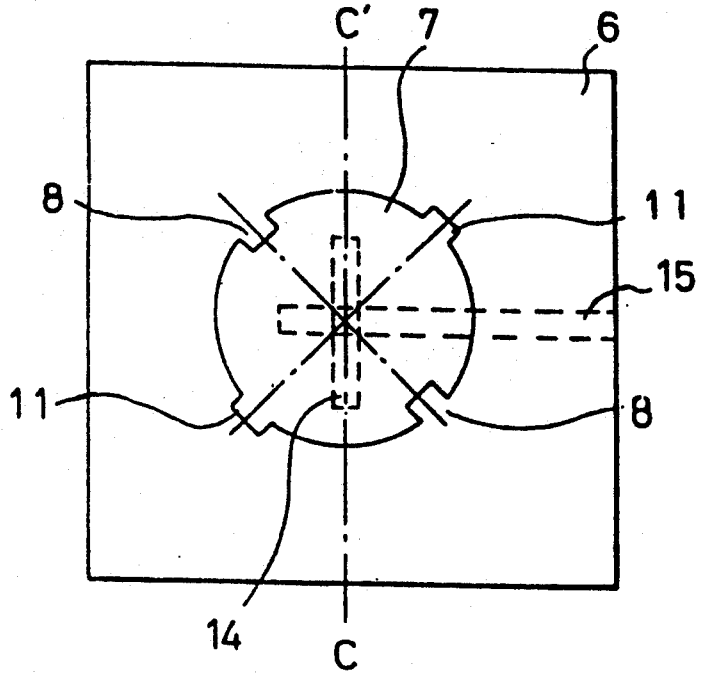
Figure 11C:
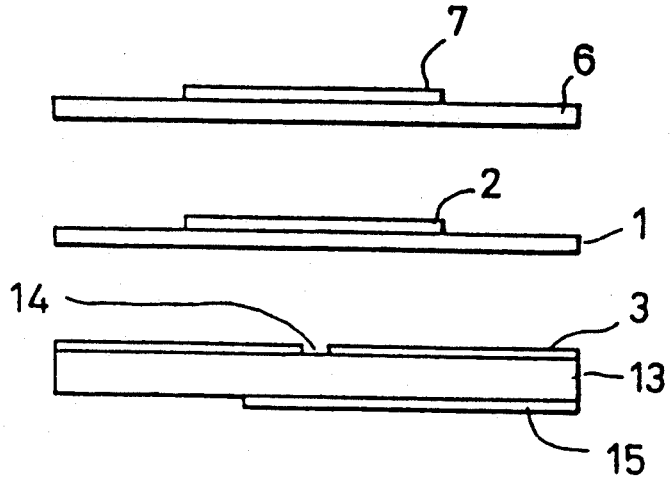

FIGS. 11A to 11C illustrate a sixth novel microstrip antenna, FIG. 11A showing an exploded oblique view, FIG. 11B a plan view, and FIG. 11C a sectional view through the plane P in FIG. 11A. Reference numerals 1 to 3 and 5 to 12 in these drawings have the same meanings as in FIG. 10. The ground plane 3 is however located not on the surface of the first dielectric substrate 1 but on a surface of a third dielectric substrate 13 disposed parallel to the first dielectric substrate 1 and the second dielectric substrate 6, more specifically on the surface facing the first dielectric substrate 1. The ground plane 3 has a slot 14 centered under the driven element 2, the axis C-C' of the slot 14 being oriented at a 45° angle to the first plane of symmetry 9 and the second plane of symmetry 10.

Instead of the conducting strip 4 in FIG. 10, this sixth microstrip antenna has a conducting strip 15 disposed on the surface of the third substrate 13 opposite to the ground plane 3, oriented at right angles to the slot 14. Thus the conducting strip 15 is also oriented at a 45° angle to the first plane of symmetry 9 and the second plane of symmetry 10. The conducting strip 15 extends from one side of the third substrate 13 across center of the slot 14 to a point beyond the center of the slot 14. The ground plane 3, the third substrate 13, and the conducting strip 15 form a microstrip transmission line for the propagation of rf current, which is coupled through the slot 14 to the driven element 2. Radio-frequency current fed from the conducting strip 15 through the slot 14 excites the driven element 2 and causes the microstrip antenna to radiate circularly polarized waves, in the same way as the first through fifth novel microstrip antennas. The sixth novel microstrip antenna has the advantage that the conducting strip 15 is shielded by the ground plane 3 from the driven element 2, hence unwanted radiation from the conducting strip 15 is suppressed.

A further dielectric substrate and ground plane may be added below the conducting strip 15 to create a tri-plate stripline transmission line instead of a microstrip transmission line.

Figure 12A:
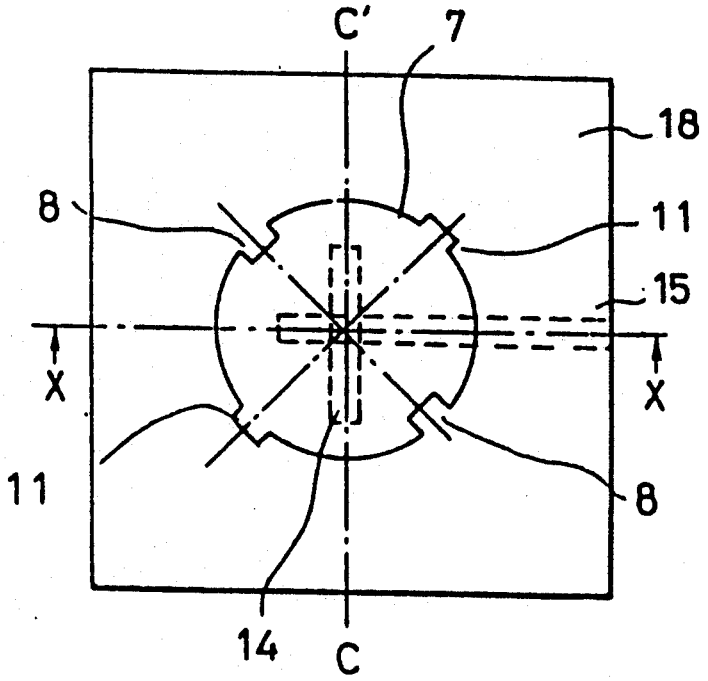
FIGS. 12A to 12B are a plan view and sectional view of a seventh novel microstrip antenna.
Figure 12B:
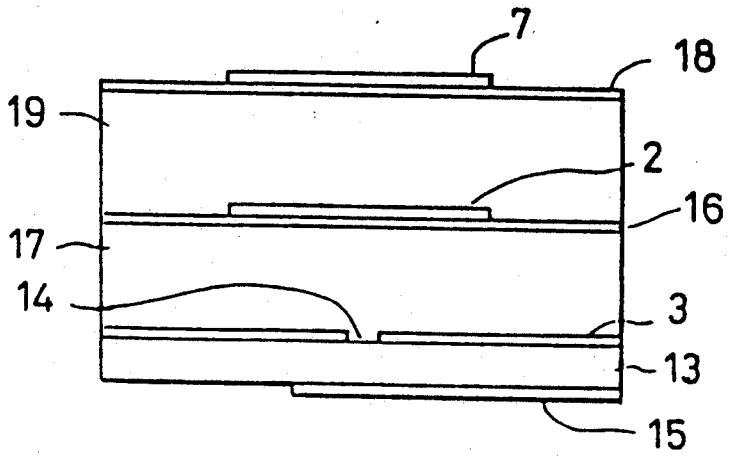

FIGS. 12A and 12B illustrate a seventh novel microstrip antenna, FIG. 12A being a plan view and FIG. 12B a sectional view through the line X-X' in FIG. 12A. Reference numerals 2, 3, and 7 to 15 have the same meaning as in FIGS. 11A to 11C. The first dielectric substrate in this microstrip antenna comprises a first thin-film dielectric 16 laminated to a first foam dielectric 17. The second dielectric substrate comprises a second thin-film dielectric 18 laminated to a second foam dielectric 19.

The driven element 2 is disposed on one surface of the first thin-film dielectric 16 as illustrated in FIG. 12B, and the parasitic element 7 is disposed on one surface of the second thin-film dielectric 18. The first thin-film substrate 16 is also laminated to the second foam dielectric substrate 19. The third dielectric substrate 13 is laminated to the first foam dielectric substrate 17, with the ground plane 3 in between.

In this embodiment, the first thin-film substrate 16 and the second thin-film substrate 18 are supported by the first and second foam dielectric substrates 17 and 19, which simplifies the support of the first and parasitic elements 2 and 7. Moreover, the foam dielectric substrates 17 and 19 have smaller permittivities and dielectric dissipation factors than dielectric substrates in general, which improves the loss characteristic of the antenna. A further advantage of the structure in FIGS. 12A and 12B is that it can be fabricated inexpensively by well-known lamination techniques.

The structures shown in FIGS. 11A to 12B, with the conducting strip 15 coupled to the driven element 2 through a slot 14 in the ground plane 3, can be employed with any of the combinations of notches and projections in the driven element 2 and the parasitic element 7 shown in FIGS. 1, 7, 8, 9, and 10.

In the preceding descriptions, the driven element 2 and the parasitic element 7 have been shown with identical diameters, but this is not a necessary condition: $R_P$ may differ from $R_D$. The notches 5 or projections 11 in the driven element 2 have been shown disposed at relative angles of 0° or 90° to the notches 8 or projections 12 in the parasitic element 7, but this also is not necessary condition: designs with other relative angles are possible. Further modifications, which will be obvious to one skilled in the art, can be made without departing from the spirit and scope of the invention, which should be determined solely from the appended claims.

What is claimed is:

1. A circularly polarized microstrip antenna, comprising:

a ground plane having a flat plate of conducting material;

a parasitic element disposed parallel to said ground plane, having a flat, generally circular conducting disk having first diametrically opposed portions of a first radius, and second diametrically opposed portions disposed perpendicular to said first diametrically opposed portions, said second diametrically opposed portions having a second radius smaller than said first radius;

a driven element disposed parallel to and between said ground plane and said parasitic element, comprising a flat, generally circular conducting disk having first diametrically opposed portions of a third radius, and second diametrically opposed portions disposed perpendicular to said first diametrically opposed portions of said third radius, said second diametrically opposed portions of said driven element having a fourth radius smaller than said third radius; and feeding means, coupled to said driven element, for feeding radio-frequency current thereto, wherein said feeding means comprises a conducting strip disposed on an extension of a diameter of said driven element, physically coupled to said driven element and forming a substantially 45° angle with said first plane of symmetry;

said first diametrically opposed portions of said parasitic element and said driven element being disposed in a first plane of symmetry perpendicular to and passing through centers of said parasitic element and said driven element; and said second diametrically opposed portions of said parasitic element and said driven element being disposed in another plane of symmetry perpendicular to said first plane of symmetry and to said parasitic and driven elements, and passing through centers of said parasitic element and said driven element.

2. The antenna of claim 1, further comprising a first dielectric substrate having said ground plane disposed on one surface and said driven element and said conducting strip disposed on an opposite surface.

3. The antenna of claim 2, further comprising a second dielectric substrate having said parasitic element disposed on one surface.

4. The antenna of claim 1, wherein said second diametrically opposed portions of said parasitic element and said driven element comprise a pair of cutout portions in said generally circular conducting disks thereof.

5. The antenna of claim 1, wherein said first diametrically opposed portions of said parasitic element and said driven element comprise a pair of projecting portions in said generally circular conducting disks thereof.

6. The antenna of claim 1, wherein said first diametrically opposed portions of said parasitic element comprise a pair of projecting portions in said generally circular conducting disk thereof, and said second diametrically opposed portions of said driven element comprise a pair of cutout portions in said generally circular conducting disk thereof.

7. The antenna of claim 1, wherein said second diametrically opposed portions of said parasitic element comprise a pair of cutout portions in said generally circular conducting disk thereof, and said first diametrically opposed portions of said driven element comprise a pair of projecting portions in said generally circular conducting disk thereof.

8. The antenna of claim 1, wherein said second diametrically opposed portions of said parasitic element and said driven element comprise a pair of cutout portions in said respective generally circular conducting disks, and wherein said first diametrically opposed portions of said parasitic element and said driven element comprise a pair of projecting portions in said generally circular conducting disks thereof.

9. A circularly polarized microstrip antenna, comprising:

a ground plane having a flat plate of conducting material;

a parasitic element disposed parallel to said ground plane, having a flat, generally circular conducting disk having first diametrically opposed portions of a first radius, and second diametrically opposed portions disposed perpendicular to said first diametrically opposed portions, said second diametrically opposed portions having a second radius smaller than said first radius;

a driven element disposed parallel to and between said ground plane and said parasitic element, comprising a flat, generally circular conducting disk having first diametrically opposed portions of a third radius, and second diametrically opposed portions disposed perpendicular to said first diametrically opposed portions of said third radius, said second diametrically opposed portions of said driven element having a fourth radius smaller than said third radius; and feeding means, coupled to said driven element, for feeding radio-frequency current thereto, wherein said feeding means comprises a conducting strip, said ground plane is disposed between said conducting strip and said driven element, and said ground plane has a slot centered with respect to said driven element for coupling said conducting strip to said driven element;

said first diametrically opposed portions of said parasitic element and said driven element being disposed in a first plane of symmetry perpendicular to and passing through centers of said parasitic element and said driven element; and said second diametrically opposed portions of said parasitic element and said driven element being disposed in another plane of symmetry perpendicular to said first plane of symmetry and to said parasitic and driven elements, and passing through centers of said parasitic element and said driven element;

said slot being oriented at a substantially 90° angle to said conducting strip, a substantially 45° angle to said first plane of symmetry, and a substantially 45° angle to said other plane of symmetry, and said conducting strip extending across a center of said slot.

10. The antenna of claim 9, further comprising a first dielectric substrate on which said driven element is disposed, a second dielectric substrate on which said parasitic element is disposed, and a third dielectric substrate having said ground plane disposed on one surface and said conducting strip disposed on an opposite surface.

11. The antenna of claim 10, wherein said first dielectric substrate comprises a first thin-film substrate and a first foam dielectric substrate, said driven element is disposed on said first thin-film substrate, said first thin-film substrate is laminated to one surface of said first foam dielectric substrate, and said third dielectric substrate is laminated to an opposite surface of said first foam dielectric substrate, said ground plane being disposed between said first foam dielectric substrate and said third dielectric substrate.

12. The antenna of claim 11, wherein said second dielectric substrate comprises a second thin-film substrate and a second foam dielectric substrate, said parasitic element is disposed on said second thin-film dielectric substrate, said second thin-film substrate is laminated to one surface of said second foam dielectric substrate, and said first thin-film dielectric substrate is laminated to an opposite surface of said second foam dielectric substrate.

13. The antenna of claim 9, wherein said second diametrically opposed portions of said parasitic element and said driven element comprise a pair of cutout portions in said generally circular conducting disks thereof, and wherein said first diametrically opposed portions of said parasitic element and said driven element comprise a pair of projecting portions in said generally circular conducting disks thereof.

* * * * *